US005197104A

United States Patent [19]

Padi

[11] Patent Number: 5,197,104

[45] Date of Patent: Mar. 23, 1993

[54] ELECTRODYNAMIC LOUDSPEAKER WITH ELECTROMAGNETIC IMPEDANCE SENSOR COIL

[75] Inventor: Gyula Padi, Lancaster, Calif.

[73] Assignee: Josef Lakatos, Brunoy, France; a part interest

[21] Appl. No.: 687,435

[22] Filed: Apr. 18, 1991

[51] Int. Cl.[5] ..... H04R 25/00

[52] U.S. Cl. ..... 381/192; 381/96; 381/194

[58] Field of Search ..... 381/194, 199, 195, 192, 381/201, 96

[56] References Cited

U.S. PATENT DOCUMENTS

| | | | |
|---|---|---|---|
| 2,007,748 | 7/1935 | Olson . | |
| 2,007,749 | 7/1935 | Anderson . | |
| 3,047,661 | 7/1962 | Winker . | |
| 3,067,366 | 12/1962 | Hofman . | |
| 3,196,211 | 7/1965 | Kessenich . | |
| 3,530,244 | 9/1970 | Reiffin | 381/96 |
| 3,686,446 | 8/1972 | Manger . | |
| 3,937,905 | 2/1976 | Manger . | |
| 4,151,379 | 4/1979 | Ashworth . | |
| 4,220,832 | 9/1980 | Nagel . | |
| 4,243,839 | 1/1981 | Takahashi . | |
| 4,256,923 | 3/1981 | Meyers | 381/96 |
| 4,492,827 | 1/1985 | Shintaku . | |
| 4,598,178 | 1/1986 | Rollins . | |
| 4,609,784 | 9/1986 | Miller . | |
| 4,783,824 | 11/1988 | Kobayashi | 381/195 |

FOREIGN PATENT DOCUMENTS

| | | | |
|---|---|---|---|
| 2703715 | 8/1978 | Fed. Rep. of Germany | 381/194 |
| 0037066 | 3/1980 | Japan | 381/195 |
| 0008997 | 1/1981 | Japan | 381/194 |
| 0575789 | 10/1977 | U.S.S.R. | 381/194 |

*Primary Examiner*—Jin F. Ng
*Assistant Examiner*—Huyen D. Le
*Attorney, Agent, or Firm*—Thomas I. Rozsa

[57] ABSTRACT

An electro-acoustic system including an amplifier circuitry for amplifying an input signal to provide an amplified signal; and electrodynamic loudspeaker having at least one magnet, a diaphragm connected to a coil support, a voice coil for driving a diaphragm in response to the amplified signal with the presence of the magnet, and an electromagnetic impedance sensor coil partically offset with the at least one magnet for providing a feedback signal proportional to its electromagnetic impedance which is a function of both the moving speed and the displacement of the diaphragm; a negative feedback circuitry processing the feedback signal and providing a negative feedback signal; and a summing circuitry for combining the input signal and the negative feedback signal and sending a combined signal to the amplifier circuitry, which in turn provides an amplified combined signal to the electrodynamic loudspeaker to thereby reduce the distortion of the electrodynamic loudspeaker.

41 Claims, 5 Drawing Sheets

Fig. 2(a)
(PRIOR ART)
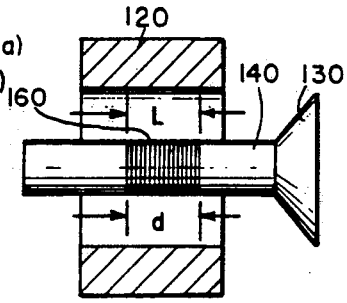
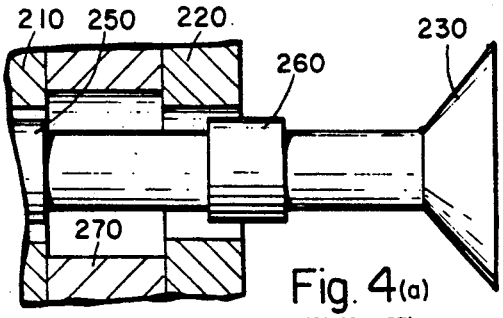
Fig. 4(a)
(PRIOR ART)
Fig. 2(b)
(PRIOR ART)
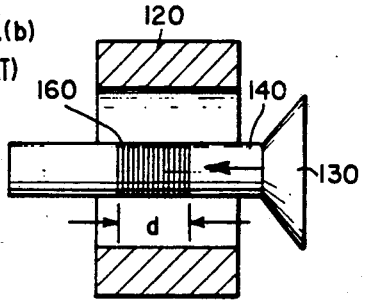
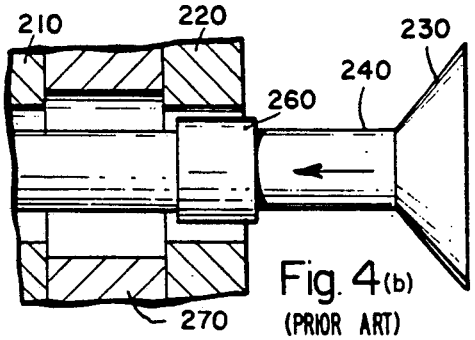
Fig. 4(b)
(PRIOR ART)
Fig. 2(c)
(PRIOR ART)
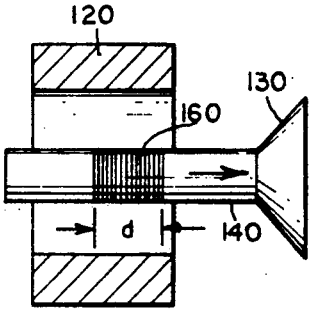
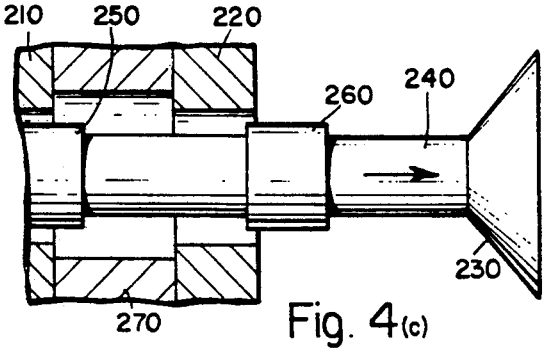
Fig. 4(c)
(PRIOR ART)
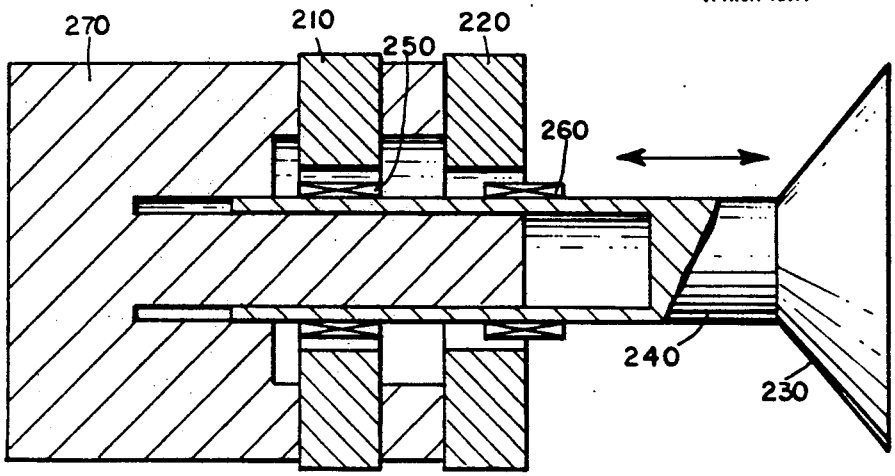
Fig. 3.

Fig. 6.
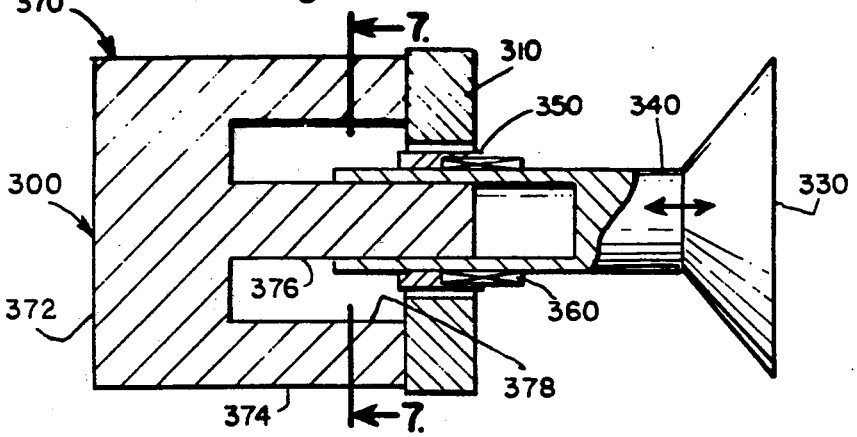
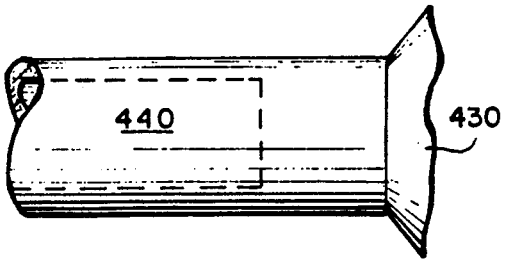
Fig. 8.
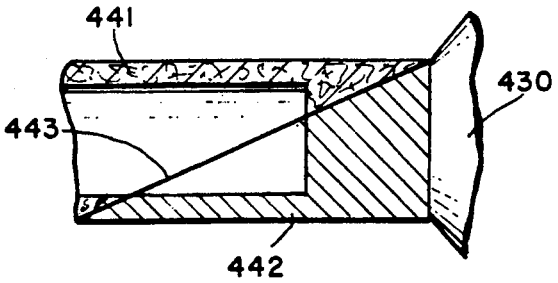
Fig. 9.
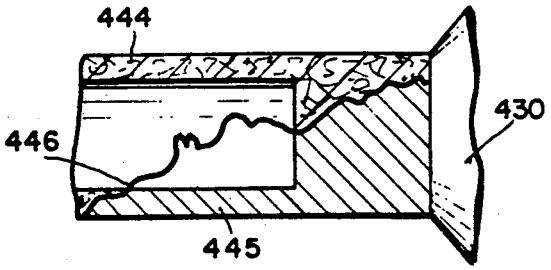
Fig. 10.
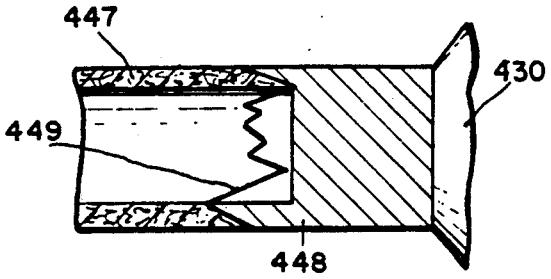
Fig. 11.

Fig. 7.
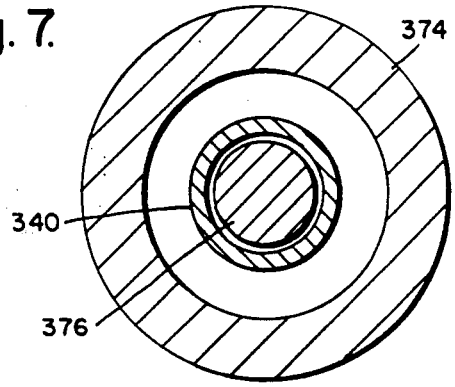
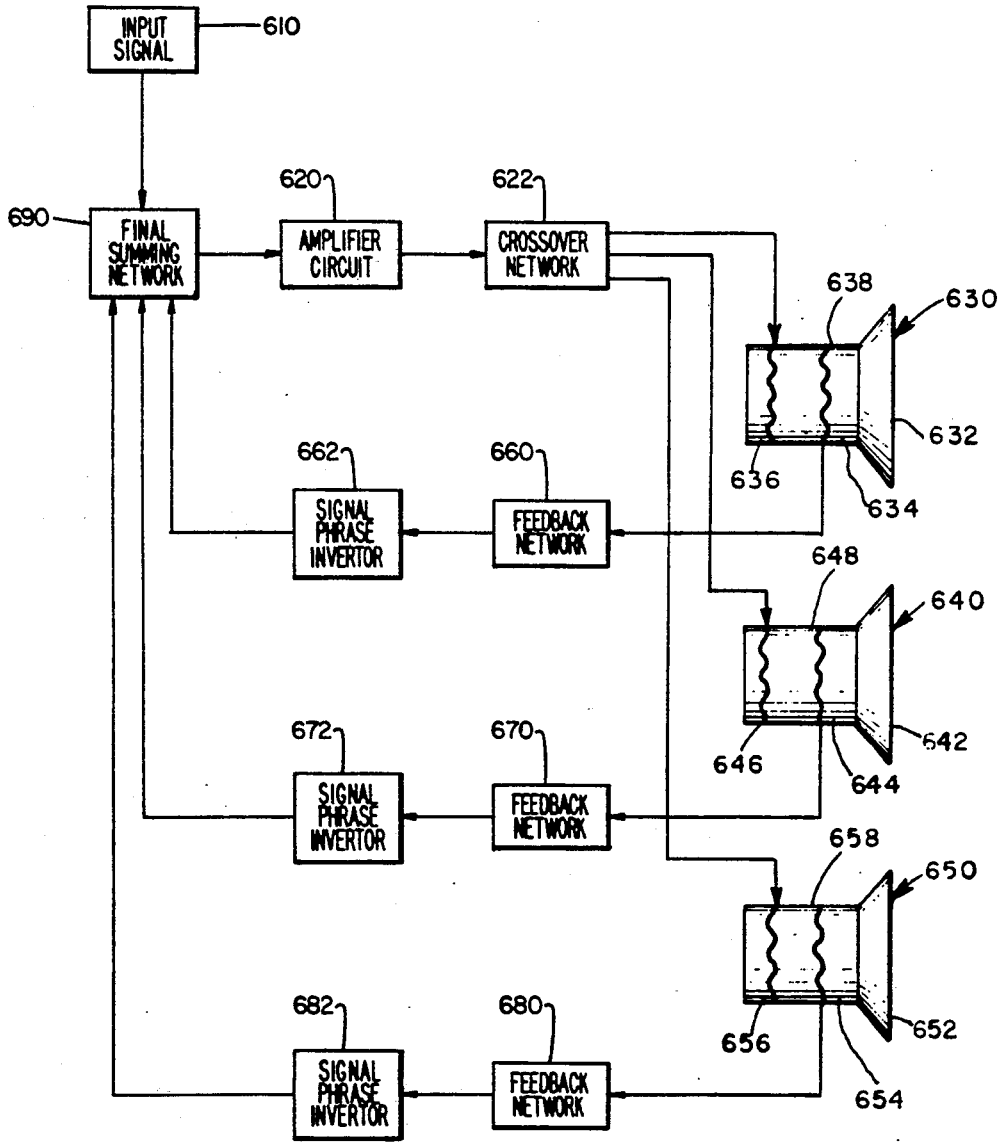
Fig. 20.

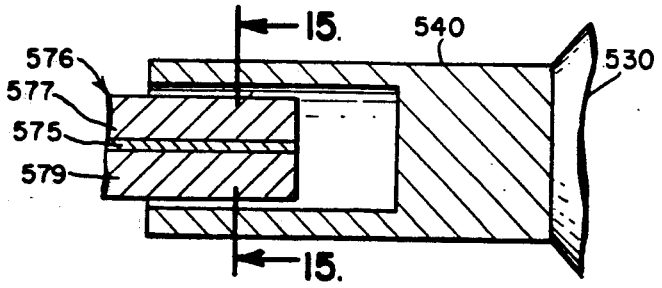
Fig. 14.
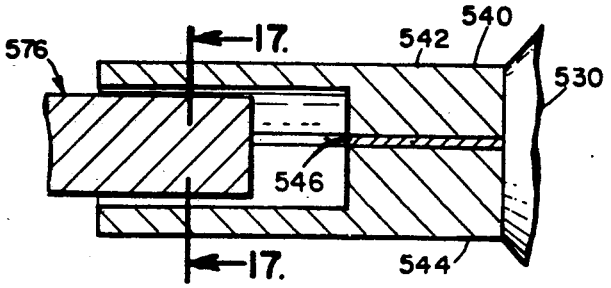
Fig. 16.
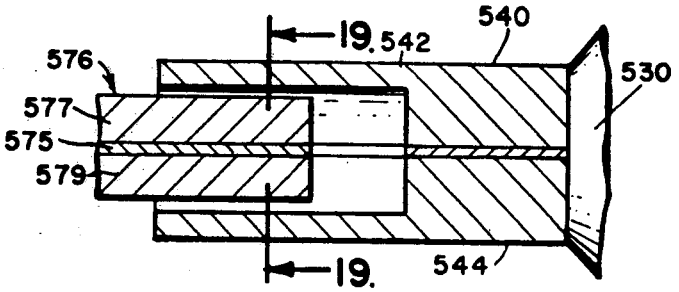
Fig. 18.
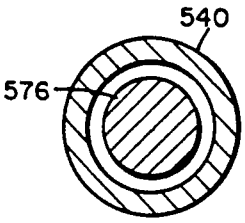
Fig. 13.
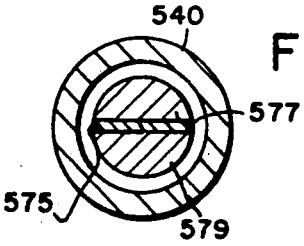
Fig. 15.
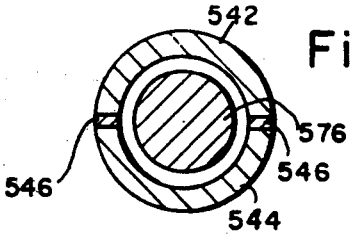
Fig. 17.
Fig. 12.
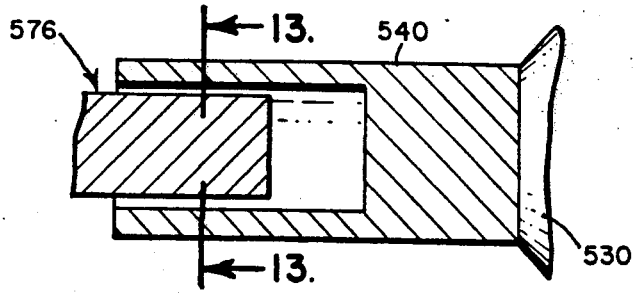
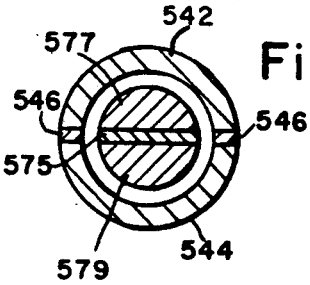
Fig. 19.

ELECTRODYNAMIC LOUDSPEAKER WITH ELECTROMAGNETIC IMPEDANCE SENSOR COIL

BACKGROUND OF THE INVENTION

1. Field of the Invention

The present invention relates to the field of electro-acoustic transducers. More particularly the present invention relates to the field of reducing the distortion of electrodynamic loudspeakers.

2. Description of the prior Art

Electrodynamic loudspeakers are electro-acoustic transducers which transform varying electrical signals to corresponding audible signals. A conventional loudspeaker typically has a housing, a magnet, a diaphragm, a coil support connected longitudinally to the diaphragm, and a voice coil wound transversely on the coil support within the magnetic field of the magnet. When varying electrical signals are provided to the voice coil, a longitudinal force is exerted upon the voice coil. The polarity of the magnetic field, the winding direction of the voice coil, and the direction of the electric current through the voice coil determine the direction of the longitudinal movement of the voice coil. As the voice coil moves, the diaphragm moves sympathetically to develop the corresponding audible signals.

Over the years there have been numerous efforts to reduce the distortion of an electrodynamic loudspeaker. The following fourteen (14) Patents have been uncovered as being most pertinent prior art references related to the present invention:

1. U.S. Pat. No. 4,783,824 issued to Kobayashi on Nov. 8, 1988 for "Speaker Unit Having Two Voice Coils Wound Around A Common Coil Bobbin," hereafter "Kobayashi ('824)".

2. U.S. Pat. No. 4,609,784 issued to Miller on Sep. 2, 1986 for "Loudspeaker With Motional Feedback," hereafter "Miller ('784)".

3. U.S. Pat. No. 4,598,178 issued to Rollins on Jul. 1, 1986 for "Means For Critically Damping A Dynamic Loudspeaker," hereafter "Rollins ('178)".

4. U.S. Pat. No. 4,492,827 issued to Shintaku on Jan. 8, 1985 for "Horn Speaker With Reduced Magnetic Flux Leakage," hereafter "Shintaku ('827)".

5. U.S. Pat. No. 4,243,839 issued to Takahashi et. al on Jan. 6, 1981 for "Transducer With Flux Sensing Coils," hereafter "Takahashi ('839)".

6. U.S. Pat. No. 4,220,832 issued to Nagel on Sept. 2, 1980 for "Two-Way Speaker With Transformer-Coupled Split Coil," hereafter "Nagel ('832)".

7. U.S. Pat. No. 4,151,379 issued to Ashworth on Apr. 24, 1979 for "Electromagnetic Speaker With Bucking Parallel High And Low Frequency Coils Drives Via Magnetic Coupling And Having Adjustable Air Gap And Slot Pole Piece," hereafter "Ashworth ('379)".

8. U.S. Pat. No. 3,937,905 issued to Manger on Feb. 10, 1976 for "Moving Voice Coil Transducer Having A Flat Diaphragm Of An Impregnated Knit,"hereafter "Manger ('905)".

9. U.S. Pat. No. 3,686,446 issued to Manger on Aug. 22, 1972 for "Push-Pull Moving Coil Loudspeaker Having Electromagnetic Centering Means," hereafter "Manger ('446)".

10. U.S. Pat. No. 3,196,211 issued to Kessenich on Jul. 20, 1965 for "Speaker Arrangement," hereafter "Kessenich ('211)".

11. U.S. Pat. No. 3,067,366 issued to Hofman on Dec. 4, 1962 for "Magnet System Having Little Stray," hereafter "Hofman ('366)".

12. U.S. Pat. No. 3,047,661 issued to Winker on Jul. 31, 1962 for "High Fidelity Audio System," hereafter "Winker ('661)".

13. U.S. Pat. No. 2,007,749 issued to Anderson on Jul. 9, 1935 for "Acoustic Apparatus," hereafter "Anderson ('749)".

14. U.S. Pat. No. 2,007,748 issued to Olson on Jul. 9, 1935 for "Acoustic Device," hereafter "Olson ('748)".

Olson ('748) discloses an electrodynamic loudspeaker comprising a large voice coil 6 and a small voice coil 7 wound on a coil support 5 in two spaced apart locations to reduce distortion. Small voice coil 7 is proximal to a diaphragm 1 and large voice coil 6 is distal to diaphragm 1. In the electrical circuit shown in FIG. 2 of the Olson Patent, small voice coil 7 is connected in series with a capacitor 11, then the two are connected in parallel with large voice coil 6.

Anderson ('749) is issued on the same day as Olson ('748) and also discloses an electrodynamic loudspeaker comprising a small voice coil 30 located near a diaphragm 12 and a large voice coil 28 located remote from diaphragm 12. The difference in Anderson ('749) compared to Olson ('748), is that in the electrical circuit shown in FIG. 4 of Anderson ('749), large voice coil 28 is connected in parallel with a capacitor 40, then the two are connected in series with small voice coil 30.

Winker ('661) discloses an audio system comprising an electrodynamic loudspeaker. Referring to FIG. 1 of Winker ('661), an audio input signal 10 is fed to amplifier 11 where it is amplified and then fed to a voice coil 12 connected to a diaphragm 14. Voice coil 12 is located within a permanent magnetic field 15, so that the amplified signal passing through it will cause it to drive diaphragm 14 which in turn produces an audible signal. The distortion that occurs in the audio system is based on various factors including the inertia of loudspeaker 13 and of the audio system and any spurious oscillation developed in amplifier 11. In order to eliminate the distortion, a negative feedback which is a function of the speed and the displacement of diaphragm 14 is introduced into the audio system. The negative feedback system of Winker ('661) comprises two sensing units: a speed sensing unit and a displacement sensing unit. The speed sensing unit includes a sensor coil 28 wound on the same coil support as voice coil 12, and located within the same magnetic field 15. As diaphragm 14 moves, sensor 28 moves together and induces an electric current which is a function of the moving speed of diaphragm 14. The induced current is fed to a speed feedback network 29 which includes an invertor for signal phase inversion. The displacement sensing unit includes a mechanical device 17 mounted to diaphragm 14 and connected to a transducer 18 having its own power source 34. Transducer 18 transduces the relative displacement of mechanical device 17 to electric voltage which is a function of the moving displacement of diaphragm 14. The transduced voltage is fed to a demodulator 37 and then to a displacement feedback network 19 which also includes an invertor for signal phase inversion. The inverted signals from speed feedback network 29 and displacement feedback network 19 are then fed together to a preliminary summing network 30 to be combined to a negative feedback signal having the same amplitude but opposite polarity as the distortion. Finally, the negative feedback is fed into a final summing network 31 where the input audio signal is combined with a negative feedback signal having the same amplitude but opposite polarity as the distortion, and the combined input audio signal is then fed to amplifier 11 to eliminate the distortion of diaphragm 14.

Hofman ('366) discloses an electrodynamic loudspeaker comprising a magnet system with additional magnets to reduce stray. The magnet system includes a hollow permanent magnet 3, a magnetic core 1 concentric inside permanent magnet 3 with space in between, a top magnetic plate 4 having an aperture concentric With magnetic core 1, and a bottom magnetic plate 2 covering the opening in permanent magnet 3.

Kessenich ('211) discloses an electrodynamic loudspeaker comprising two voice coils 20 and 21 wound on a coil support 14 such that one is wound over the other. Voice coils 20 and 21 are wound in opposite directions and the electric currents provided to voice coils 20 and 21 are also in opposite directions. Therefore, the force in the longitudinal direction is enhanced and the other misalignment force in the transverse direction is balanced out.

Manger ('446) discloses an electrodynamic loudspeaker comprising an electromagnetic centering means having two driving coils 5 and 6 provided with electric currents for providing balanced forces to return a diaphragm 7 to a datum position so that the distortion at low frequencies can be reduced.

Manger ('905) discloses an electrodynamic loudspeaker having a similar arrangement as the first Manger Patent. The improvement is made to the diaphragm. The improved diaphragm comprises a flat textile carrier 14 impregnated with a highly attenuating filling material and is highly elastic in its plane but inelastic in bending, so that the distorted sound waves reproduced by the diaphragm can be reduced.

Ashworth ('379) discloses an electrodynamic loudspeaker comprising a treble voice coil 6 and a bass voice coil 7 wound on a single magnetizable coil supporting core 4 to activate a magnetizable sounding board 10 at the proximal end of coil supporting core 4, and to supply magnetic energy at the distal end of coil supporting core 4 for a second diaphragm 17 via another coil 15.

Nagel ('832) discloses a two-way electrodynamic loudspeaker system comprising a large loudspeaker 11 and a small loudspeaker 111. Large loudspeaker 11 has two voice coils **14*a* and 14*b* coupled by an input transformer 48** for increasing the energy efficiency over a broad frequency range.

Takahashi ('839) discloses an electrodynamic loudspeaker comprising two magnetic flux sensor coils for negative feedback. In the preferred embodiment of Takahashi ('839) shown in FIG. 1, a first sensor coil 6 is proximal to the diaphragm on one side of a voice coil 5, and a second sensor coil 7 is distal to the diaphragm on the other side of voice coil 5. When the feedback signals from sensor coils 6 and 7 are fed to an amplifier 8, a voltage in proportion to the change of magnetic flux is produced by provides a negative feedback force to the diaphragm that is proportional to the change of signal current flowing through voice coil 5. In an alternative embodiment of Takahashi ('839) shown in FIG. 16, a first sensor coil 27 is proximal to the diaphragm on one side of a voice coil 26, and a second sensor coil 28 is distal to the diaphragm on the other side of voice coil 26. When the feedback signals from sensor coils 27 and 28 are fed to an amplifier 29, a voltage in proportion to the change of magnetic flux is produced by amplifier 29. When an input signal current is flowing through voice coil 26 to drive the diaphragm, a voltage in proportion to the input signal current is presented across a resistor 30. The voltage from amplifier 29 and the voltage across resistor 30 are fed to a multiplier 31. As a result, multiplier 31 produces a feedback signal in proportion to the product of the change of the magnetic flux and the input signal current, which is theoretically proportional to the distortion of the current in voice coil 26. Therefore, when the feedback signal is fed to the negative terminal of the amplifier 32 and the audio input signal is fed to the positive terminal of the same amplifier 32, the combined input signal can eliminate the distortion in voice coil 26.

Shintaku ('827) discloses an electrodynamic loudspeaker comprising a secondary magnetic piece 17 in addition to a primary magnetic piece 16 to reduce the magnetic flux leakage.

Rollins ('178) discloses an electrodynamic loudspeaker with means for critically damping the movement of the diaphragm. In addition to a voice coil 24 wound on a coil support 23 and located within the magnetic field of a permanent magnet 28, Rollins ('827) comprises a driving coil 30 wound on the same coil support 23 at a location distal to the diaphragm such that it only enters the magnetic field of magnet 28 when the diaphragm moves at its extreme excursion. Upon the occurrence of such excursion, driving coil 30 can be selectively enabled by an external circuit to damp the movement of the diaphragm.

Miller ('784) discloses an electrodynamic loudspeaker comprising a voice coil 20 wound on a coupling 22 connected to a diaphragm 24 and located within a primary magnetic field, and two sensor coils 38 and 40 wound on the same coupling 22 and located within a second magnetic field. The two sensor coils are electrically connected in anti-phase.

Kobayashi ('824) discloses an electrodynamic loudspeaker comprising a first voice coil 24 located near the magnetic field of a first magnet 4 and a second voice coil 25 located near the magnetic field of a second magnet 5 which is provided for suppressing flux leakage of first magnet 4.

Overall, the prior art Patents can be approximately divided into three groups providing three different approaches to reduce the distortion of an electrodynamic loudspeaker. The approach of the first group of prior art patents is primarily to add more voice coils or other driving coils to balance the diaphragms of the loudspeakers. The first group includes Olson ('748), Anderson ('749), Kessenich ('211), Manger ('446) & ('905), Ashworth ('379), Nagel ('832), Rollins ('178) and Kobayashi ('824). The approach of the second group of prior art patents is primarily to add more magnets to balance the magnetic fields in the loudspeakers. The second group includes Hofman ('366) and Shintaku ('827). It should be pointed out that some of the prior art patents of the first group also have magnetic assemblies with extra magnets to balance the magnetic fields of the loudspeakers. The approach of the third group of the prior art patents is primarily to add one or more sensor coils to feedback signals which are functions of the motion of the diaphragms of the loudspeakers. The third group includes Winker ('661), Takahashi ('839) and Miller ('784).

The approach of the third group of the prior art patents has proven to be very effective in reducing the distortion of a loudspeaker. The main concept of this approach is to add sensor coils which move accordingly with the diaphragm of a loudspeaker for producing feedback signals. Winker ('661) uses a sensor coil 28 to detect the moving speed of the diaphragm. Since an accurate negative feedback signal should be a function of both the speed and the displacement of the diaphragm, Winker ('661) uses additional apparatus, such as a capacitor transducer, an ionization transducer or a pressure responsive resistor, to detect the displacement of the diaphragm. The major disadvantage of Winker ('661) is that its displacement detecting apparatus all comprise mechanical attachments, such as an arm 17, attached to the diaphragm, and the detecting components with their own power sources, such as multiplates capacitors or pressure responsive resistors, have to be located adjacent to the mechanical attachments, which makes the loudspeaker somewhat too large and heavy thus not applicable for many compact devices such as earphones. In fact, for conventional markets there has been no practical loudspeaker designed and built such as the Winker ('661) loudspeaker. Takahashi ('839) later provides a different solution by using two sensor coils on each side of the voice coil to measure the change of the magnetic flux of the magnetic field when the diaphragm is moving and feeding back the feedback signal to a driving coil which in turn provides a negative feedback force to the diaphragm that is proportional to the change of signal current flowing through the voice coil. The Takahashi ('839) loudspeaker also requires a larger housing for the loudspeaker because of the numerous extra coils and complicated magnet assemblies. Miller ('784) is concerned about having the sensor coil located together with the voice coil within the same primary magnetic field, such as Winker ('661) does, because of the electromagnetic interference, the so-called "transformer effect," between them. Miller ('784) provides a simple assembly having a pair of sensor coils electrically connected in anti-phase and separately located in a secondary magnetic field away from the voice coil and the primary magnetic field. However, it is known that such a sensor coil arrangement is merely adequate for detecting the moving speed of the diaphragm, as discussed in Takahashi ('839) from Line 4, Column 9 to Line 32, Column 10, and that is why Winker ('661) employs additional apparatus to detect the displacement of the diaphragm.

Referring to FIG. 1, there is shown the circuitry and arrangement of a most relevant prior art conventional electrodynamic loudspeaker 100. An audio input signal 10 is input to an amplifier 20 where it is amplified and sent to loudspeaker 100. Loudspeaker 100 comprises a primary magnet 110, a secondary magnet 120, a diaphragm 130, a coil support 140 attached to diaphragm 130, a voice coil 150 wound on coil support 140 and located within the magnetic field of primary magnet 110 which is referred to as the primary magnetic field, and a sensor coil 160 wound on coil support 140 and located within the magnetic field of secondary magnet 120 which is referred to as the secondary magnetic field. The amplified input signal is sent into and passes through voice coil 150 and causes voice coil 150 to drive diaphragm 130 to move back and forth because of the presence of the primary magnetic field. As diaphragm 130 moves back and forth, so does sensor coil 160 which transduces a first feedback signal that is proportional to the moving speed of diaphragm 130. This first feedback signal is fed to a speed feedback network 30 which includes an invertor for signal phase inversion. As diaphragm 130 moves back and forth, a mechanical attachment 42 attached to diaphragm 130 also moves accordingly and a transducer 40 transduces the displacement of diaphragm 130 to an electronic signal. Transducer 40 is energized by its own power source 50. The electronic signal from transducer 40 is fed to a modulator 60, which in turn produces a second feedback signal that is proportional to the displacement of diaphragm 130. This second feedback signal is fed to a displacement feedback network 70 which also includes an invertor for signal phase inversion. Speed feedback network 30 then produces a first negative feedback signal at 180 degrees out of phase with the first feedback signal and feeds the first negative feedback signal in the proper proportion into a preliminary summing network 80. Displacement feedback network 70 also produces a second negative feedback signal at 180 degrees out of phase with the second feedback signal and feeds the second negative feedback signal in the proper proportion into preliminary summing network 80. The preliminary summing network 80 combines the first and second negative feedback signals and produces a combined negative feedback signal which is a function of both the speed and the displacement of diaphragm 130. The combined negative feedback signal is fed in the proper proportion to a final summing network 90 where it is combined with the input audio signal Finally the combined input signal is sent into loudspeaker 100 and the distortion of diaphragm 130 is thus eliminated.

SUMMARY OF THE PRESENT INVENTION

The present invention is an electrodynamic loudspeaker with an electromagnetic impedance sensor coil.

It is known that adding motional sensor coils for producing negative feedback signals is an effective way to reduce the distortion of an electrodynamic loudspeaker. It is also known that it is necessary to detect both the speed and the displacement of the diaphragm of the loudspeaker for providing the accurate feedback signals. It is further known that the interference between the sensor coils and the voice coils can be reduced by having the sensor coils located in a secondary magnetic field separate from the primary magnetic field where the voice coil is located.

It has been discovered, according to the present invention, that if the electromagnetic impedance of a sensor coil can be detected, then a feedback signal can be deduced which is a function of both the speed and the displacement of the diaphragm because the impedance is a function of not only the speed of the sensor coil, but also the relative positions of the sensor coil and the iron core wherein the sensor coil is located.

It has additionally been discovered, according to the present invention, that if the sensor coil is offset from a secondary iron core, then the changes of the electromagnetic impedance can be detected when it moves accordingly with the diaphragm more or less into or out of the secondary iron core.

It has also been discovered, according to the present invention, that if the sensor coil moves accordingly with the diaphragm more or less into or out of the secondary iron core, then the capacitance between (a) the pole pieces; or (b) the pole piece(s) and the magnet; or (c) the pole piece(s) and the coil support of the loudspeaker is changing.

It has further been discovered, according to the present invention, that if the impedance of the sensor coil is changing, then the frequency of an attached oscillator is changing accordingly, and when the changing frequency is fed to a frequency to voltage convertor of a feedback network, the feedback network can measure the impedance of the sensor coil and produce a negative feedback signal which is a function of both the speed and the displacement of the diaphragm.

It has additionally been discovered, according to the present invention, that if the coil support of the electrodynamic loudspeaker is made with both conductive and non-conductive materials, then proper adjustment of the structural combination of the conductive and non-conductive materials can improve the linearity of the coils wound on the coil support.

It has also been discovered, according to the present invention, that if the structural combination of the pole piece and the coil support of the electrodynamic loudspeaker is constructed as a large coaxial capacitor, then its capacitance is changing when the coil support moves back and forth with the diaphragm, and the changing capacitance can be measured as a feedback signal.

It has further been discovered, according to the present invention, that if an electro-acoustic system is built to include the above described electrodynamic loudspeakers with a negative feedback network to provide an input signal combined with negative feedback signal, then the distortion of the loudspeakers can be greatly reduced.

It is therefore an object of the present invention to provide an electrodynamic loudspeaker wherein the electromagnetic impedance of a sensor coil can be detected, so that a feedback signal can be deduced which is a function of both the speed and the displacement of the diaphragm because the impedance is a function of not only the speed of the sensor coil, but also the relative positions of the sensor coil and the iron core wherein the sensor coil is located.

It is an additional object of the present invention to provide an electrodynamic loudspeaker wherein the sensor coil is offset from a secondary iron core, so that its electromagnetic impedance can be detected when it moves accordingly with the diaphragm more or less into or out of the secondary iron core.

It is also an object of the present invention to provide an electrodynamic loudspeaker wherein the sensor coil is offset from a secondary iron core, so that the changing in capacitance between (a) the pole pieces; or (b) the pole piece(s) and the magnet; or (c) the pole piece(s) and the coil support of the loudspeaker can be detected when the sensor coil moves accordingly with the diaphragm more or less into or out of the secondary iron core.

It is further object of the present invention to provide an electrodynamic loudspeaker wherein the frequency of an oscillator changes according to the changing of the impedance of the sensor coil, and the changing frequency is fed to a frequency to voltage convertor of a feedback network, so that the feedback network can measure the impedance of the sensor coil and produce a negative feedback signal for the amplifier, which is a function of both the speed and the displacement of the diaphragm.

It is an additional object of the present invention to provide an electrodynamic loudspeaker having coil support made with both conductive and non-conductive materials, so that proper adjustment of the structural combination of the conductive and non-conductive materials can improve the linearity of the coils wound on the coil support.

It is also an object of the present invention to provide an electrodynamic loudspeaker wherein the structural combination of the pole piece and the coil support of the electrodynamic loudspeaker is constructed as a large coaxial capacitor, so that its capacitance is changing when the coil support moves back and forth with the diaphragm, and the changing capacitance can be measured as a feedback signal.

It is also an object of the present invention to provide an electro-acoustic system which includes the above described electrodynamic loudspeakers with a negative feedback network to provide an input signal combined with a negative feedback signal, so that the distortion of the loudspeakers can be greatly reduced.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 2 is a schematic diagram of the sensor coil and secondary magnetic field arrangement of the prior art loudspeaker showing their relative positions as the diaphragm moves back and forth.

FIG. 3 is a schematic diagram of a preferred embodiment of the present invention electrodynamic loudspeaker with electromagnetic impedance sensor coil.

FIG. 4 is a schematic diagram of the sensor coil and secondary iron core arrangement of the present invention loudspeaker showing their relative positions as the diaphragm moves back and forth.

FIG. 6 is a schematic diagram of an alternative embodiment of the present invention electrodynamic loudspeaker with electromagnetic impedance sensor coil.

FIG. 7 is a cross-sectional view taken along dotted line 7—7 of FIG. 6.

FIG. 8 is a schematic diagram of one embodiment of the coil support of the present invention electrodynamic loudspeaker with electromagnetic impedance sensor coil.

FIG. 9 is a schematic diagram of a second embodiment of the coil support of the present invention electrodynamic loudspeaker with electromagnetic impedance sensor coil.

FIG. 10 is a schematic diagram of a third embodiment of the coil support of the present invention electrodynamic loudspeaker with electromagnetic impedance sensor coil.

FIG. 11 is a schematic diagram of a fourth embodiment of the coil support of the present invention electrodynamic loudspeaker with electromagnetic impedance sensor coil.

FIG. 12 is a schematic diagram of the pole piece and coil support combination of the present invention electrodynamic loudspeaker with electromagnetic impedance sensor coil.

FIG. 13 is a cross-sectional view taken along dotted line 13—13 of FIG. 12.

FIG. 14 is a schematic diagram of an alternative embodiment of the pole piece and coil support combination of the present invention electrodynamic loudspeaker with electromagnetic impedance sensor coil.

FIG. 15 is a cross-sectional view taken along dotted line 15—15 of FIG. 14.

FIG. 16 is a schematic diagram of another alternative embodiment of the pole piece and coil support combination of the present invention electrodynamic loudspeaker with electromagnetic impedance sensor coil.

FIG. 17 is a cross-sectional view taken along dotted line 17—17 of FIG. 16.

FIG. 18 is a schematic diagram of a further alternative embodiment of the pole piece and coil support combination of the present invention electrodynamic loudspeaker with electromagnetic impedance sensor coil.

FIG. 19 is a cross-sectional view taken along dotted line 19—19 of FIG. 18.

FIG. 20 is a schematic diagram of an electro-acoustic system incorporating the present invention which includes three electrodynamic loudspeakers.

DETAILED DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
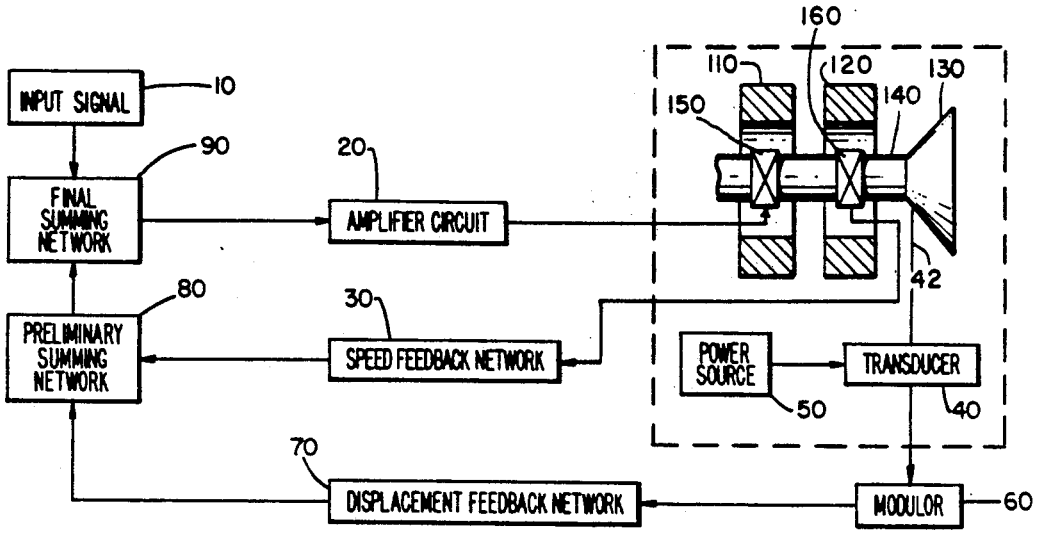
Fig. 1. (PRIOR ART)
FIG. 1 is a schematic diagram of the circuitry and arrangement of a most relevant prior art conventional electrodynamic loudspeaker.

According to electromagnetic theories, electromagnetic impedance of a sensor coil moving in an iron core is a function of the position of the sensor coil. The electromagnetic impedance of the sensor coil is a function of the position of the sensor coil moving in the iron core and is also a function of the change of the "overlapped length" of the sensor coil. The overlapped length of a sensor coil is the length of the sensor coil within the iron core. The "total length" of a sensor coil is the total longitudinal dimension of the sensor coil when it is wound on a longitudinal coil support. Referring to FIG. 2(a), there is illustrated part of prior art loudspeaker 100 shown in FIG. 1. Sensor coil 160 is wound on longitudinal coil support 140 attached to diaphragm 130 and located within the secondary iron core 120. The total length of sensor coil 160 is denoted by "L", and the overlapped length of sensor coil 160 is denoted by "d". FIG. 2(*a*) shows that diaphragm 130 is at its central position, FIG. 2(*b*) shows that diaphragm 130 moves backwardly, and FIG. 2(*c*) shows that diaphragm 130 moves forwardly. The arrangement of sensor coil 160 of prior art loudspeakers has a common feature which feature is that the overlapped length "d" of sensor coil 160 is always the same as the total length "L". Since the electromagnetic impedance of sensor coil 160 is also a function of the change of the overlapped length of sensor coil 160, it cannot be measured from the arrangement of the prior art loudspeakers.

Referring to FIG. 3, there is shown at 200 a preferred embodiment of the present invention electrodynamic loudspeaker with electromagnetic impedance sensor coil. The present invention loudspeaker comprises a pole piece 270, a primary magnet 210, a secondary iron core 220, a diaphragm 230, a coil support 240 mounted to diaphragm 230, and a voice coil 250 wound on coil support 240. The present invention loudspeaker may further comprise a housing. Pole piece 270 may be a pole assembly mounted to the housing of the loudspeaker. Primary magnet 210 may be an annular permanent magnet or magnet assemblies. Secondary iron core 220 may be a ferrite ring or ferrite assemblies. Primary magnet 210 and secondary iron core 220 may be supported by pole piece 270 or the housing of the loudspeaker. Coil support 240 may be a support assembly. Diaphragm 230 or coil support 240 may be suspended on the magnet, the iron core, the pole piece or the housing of the loudspeaker. The voice coil may be a coil assembly having a group of coils or split coils for desired purposes such as enhanced performance in different frequency ranges. The loudspeaker may also include other components such as mounting pieces. All these are conventional in the art. The novel and critical feature of the present invention loudspeaker is that the sensor coil 260 wound on coil support 230 is now offset from secondary iron core 220. Only part of sensor coil 260 is located within the secondary iron core 220 which makes it possible to measure the electromagnetic impedance of sensor coil 260. Therefore sensor coil 260 is not only a sensor coil which senses the speed of the diaphragm as in prior art loudspeakers, but also an electromagnetic impedance sensor coil.

FIG. 4 is the present invention compared to the prior art as shown in FIG. 2. Again, the total length of sensor coil 260 is denoted by "L", the overlapped length of sensor coil 260 is denoted by "d". FIG. 4(*a*) shows diaphragm 230 of the present invention loudspeaker at its central position, electromagnetic impedance sensor coil 260 is shown at its normal position which is offset from the secondary iron core 220, so that its overlapped length "d" is about half of its the total length "L". FIG. 4(*b*) shows diaphragm 230 moving backwardly, electromagnetic impedance sensor coil 260 also moves backwardly, and its overlapped length d is increased substantially to almost the same as its total length "L". FIG. 4(*c*) shows that when diaphragm 230 moves forwardly, electromagnetic impedance sensor coil 260 also moves forwardly, and its overlapped length "d" is decreased substantially to almost zero. The displacement of diaphragm 230 is reflected by the change of the overlapped length "d" of electromagnetic impedance sensor coil 260. Since the electromagnetic impedance is also a function of the change of the overlapped length "d", the measurement of the electromagnetic impedance of sensor coil 260 will provide an electromagnetic feedback signal which is also a function of the displacement of diaphragm 230.

Figure 5:
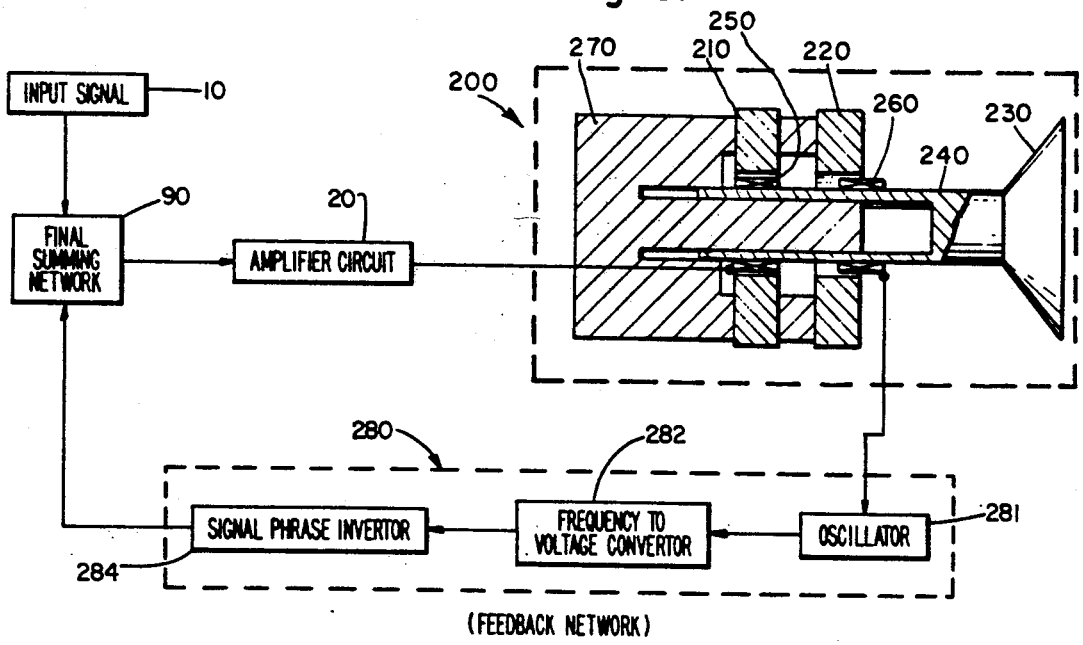
FIG. 5 is a schematic diagram of the circuitry and arrangement of the preferred embodiment of the present invention electrodynamic loudspeaker with electromagnetic impedance sensor coil.

Referring to FIG. 5, there is shown the circuitry and arrangement of a preferred embodiment of the present invention electrodynamic loudspeaker 200. Again an audio input signal 10 is input to an amplifier 20 where it is amplified and sent to the present invention loudspeaker 200. The amplified input signal is sent into and passes through voice coil 250 and causes voice coil 250 to drive diaphragm 230 to move back and forth because of the presence of the primary magnetic field of primary magnet 210. As diaphragm 230 moves back and forth, so does electromagnetic impedance sensor coil 260 which transduces a feedback signal that is proportional to the electromagnetic impedance of sensor coil 260. The changing impedance of the sensor coil 260 causes the frequency of an oscillator 281 to change, and the changing frequency is fed to a feedback network 280. It is understood that the oscillator block 281 is drawn separately from the sensor coil 260 merely for the clarity of the diagram. In fact sensor coil 260 is considered to be part of the oscillator too. When the impedance of sensor coil 260 is changing, the whole frequency of the oscillator is changing. Feedback network 280 includes a frequency to voltage convertor 282 and a signal phase invertor 284. The electromagnetic impedance of sensor coil 260 is measured as a function of frequency of oscillator 281 and converted to a feedback voltage by convertor 282. Then invertor 284 produces a negative feedback signal at 180 degrees out of phase with the feedback voltage signal from voltage convertor 282, which is an accurate function of both the moving speed and the displacement of diaphragm 230, and feeds the negative feedback signal in the proper proportion into the final summing network 90 where it is combined with the input audio signal. Finally, the combined input signal is sent into the present invention loudspeaker 200 and the distortion of diaphragm 230 is successfully eliminated. All these circuitry components are conventional in the art. The unique feature of the present invention loudspeaker system is that the feedback circuitry picks up the electromagnetic impedance of the electromagnetic impedance sensor coil and converts it into a negative feedback signal which is an accurate function of both the moving speed and the displacement of the diaphragm of the loudspeaker. It will be appreciated that in the present invention the changing impedance may be measured and represented not only by frequency but other physical quantities as well, where detecting and measuring device 282 and invertor 284 are alternatively embodied according to these particular physical quantities.

Referring to FIG. 6, there is shown at 300 an alternative embodiment of the present invention electrodynamic loudspeaker with electromagnetic impedance sensor coil. The alternative embodiment of the present invention loudspeaker comprises a pole piece 370, a single magnet 310, a diaphragm 330, a coil support 340 mounted to diaphragm 330, a sensor coil 360 bifilarly wound on coil support 340 and offset from magnet 310, and a voice coil 350 wound on the outer periphery of sensor coil 360. The distinct feature of this embodiment of the present invention loudspeaker is that (a) there is no extra secondary iron core needed, the inductance is increased by placing a substance with high magnetic permeability within the coil, such materials include iron, powdered iron and ferrite; and (b) sensor coil 360 is a bifilar winding, so called double-winding or fieldless coil. The wire is folded back on itself and the wound is doubled, with the winding starting from the point at which the wire is folded. When sensor coil is moving in the magnetic field of magnet 310, the respective signals induced in the two windings of sensor coil 360 are opposite and thus canceled each other out. This will reduced the interferences between the magnetic field and the coils which in turn reduce the distortion of diaphragm 330. Yet sensor coil 360 is still offset from magnet 310, so when it moves with diaphragm 330 via coil support 340, its changing impedance is measurable.

It will be appreciated that the present invention is not limited to only measure the impedance of the sensor coil. Other physical quantities may be measured as well for the negative feedback network. For example, referring to FIGS. 6 and 7, the pole piece 370 of the present invention may be considered as a large coaxial capacitor. Pole piece 370 is generally a hollow cylinder having a base 372, a sidewall 374 and a central rod 376. When pole piece 370 is made of electrical conductive substances, then it may constitute a large capacitor where central rod 376 and sidewall 374 serve as its two opposite electrodes. One factor effecting its capacitance is its dielectric, which is the substances located in the annular hollow gap 378 between sidewall 374 and central rod 376. As shown in FIGS. 6 and 7, the dielectric substances include air and coil support 340. When diaphragm 330 moves back and forth, all of the above dielectric substances moves accordingly, and consequently the dielectric of pole piece 370 as a large capacitor is changing which in turn changes the capacitance of pole piece 370 This change in capacitance can be measured and used as a feedback signal because it is also a function of the moving speed and displacement of diaphragm 330. This changing capacitance of pole piece 370 may be used alone or together with the impedance of sensor coil 360 for the feedback network. The same arrangement may be applied to the present invention embodiment showing in FIG. 3 where pole piece 270 has similar configuration.

To help measure the changing capacitance, the central rod 372 of the pole piece may be constructed alternatively, and combined with alternative constructions of the coil support. The alternative combinations of the pole piece and the coil support are shown in FIGS. 12–19. Shown in FIGS. 12, 14, 16 and 18, the central rod 576 of the pole piece is extended into the hollow chamber of coil support 540 which is attached to diaphragm 530. As shown in FIGS. 12 and 13, the combination of central rod 576 of the pole piece and coil support 540 constitutes a large capacitor whose capacitance is changing when coil support 540 is moving with diaphragm 530 and can be measured as feedback signals. Referring to FIGS. 14 and 15, central rod 576 of the pole piece is constructed with two conducting halves insulated to each other by an insulating layer 575, so that each half constitutes an electrode of a respective capacitor. When coil support 540 moves back and forth with diaphragm 530, the capacitance of the respective capacitor is changing accordingly. The changing capacitance can be measured and used as a feedback signal for the negative feedback network. The same principle can be applied to the coil support too. As shown in FIGS. 16 and 17, the coil support 540 is constructed with two halves, each made of conducting material, and each half insulated from the other half by an insulating layer 546, so that each half constitutes an electrode of a respective capacitor. The above half-half constructions of the central rod 576 of the pole piece and the coil support 540 can be combined to construct the combination structure shown in FIG. 18 and 19 where both the central rod 576 of the pole piece and the coil support 540 are constructed with two respective insulated halves, which in turn constitute two electrodes of respective capacitors. Therefore, when coil support 540 moves back and forth with diaphragm 530, the capacitances of respective capacitors are changing accordingly, and the changing capacitances can be measured and fed back to the negative feedback network.

Another feature of the present invention is the alternative construction of the coil support member 270 or 370. Most prior art coil supports are constructed by non-conductive materials such as hard paper board or insulated plastic. To improve the linearity of the coils wound on it, the present invention coil support may be constructed with both non-conductive and conductive materials. These alternative embodiments of the coil support are shown in FIGS. 8–11. Referring to FIG. 8, a coil support 440 is attached to a diaphragm 430. Coil support 440 is similar to coil support 240 shown in FIG. 3, and similar to coil support 340 shown in FIG. 6. Coil support 440 is constructed by only the non-conductive material. Alternatively, the coil support shown in FIG. 9 is constructed to have a non-conductive portion 441 and a conductive portion 442. The boundary 443 of non-conductive portion 441 and conductive portion 442 is diagonal so that the conductivity of the coil support gradually increases. The boundary between the non-conductive portion and the conductive portion is not absolute, nor does it have to be straight. The boundary is rather determined by the arrangement of the coils to better offset their non-linearity. As for the coil support shown in FIG. 10, the boundary 446 between the non-conductive portion 444 and conductive portion 445 is crooked and generally longitudinal along the axial direction of the coil support, whereas for the coil support shown in FIG. 11, the boundary 449 between the non-conductive portion 447 and conductive portion 448 is also crooked but generally transversal. Other arrangement may well be embodied for the coil support present invention loudspeaker.

Referring to FIG. 20 there is shown an electro-acoustic system incorporating the present invention which includes three electrodynamic loudspeakers. It is understood that any number of speakers may be included in the system. For the embodiment shown in FIG. 20 the three speakers are a tweet speaker 630, a mid-range speaker 640 and a woofer speaker 650. All three speakers may incorporate the preferred or alternative embodiments of the present invention. For example, voice coils 636, 646, and 656 and sensor coils 638, 648 and 658 are wound respectively on coil supports 634, 644 and 654 which are respectively attached to diaphragms 632, 642 and 652. An audio input signal 610 is input to an amplifier 620 where it is amplified and sent to a cross-over network 622. From cross-over network 622 the amplified input signal is sent into and passes through all three voice coils 636, 646 and 656 and causes voices coils 636, 646 and 656 to drive diaphragms 632, 642 and 652 respectively. As diaphragms 632, 642 and 652 move back and forth, so do sensor coils 638, 648 and 658 and each will transduce a feedback signal that is proportional to the electromagnetic impedance of the respective sensor coil. The changing impedances of the sensor coils 638, 648 and 658 are fed back into three respective feedback networks 660, 670 and 680 each including an oscillator and frequency-voltage convertor. The electromagnetic impedance of sensor coils 638, 648 and 658 are measured as functions of frequencies of the oscillators and converted to feedback voltages by the convertors. The feedback voltages from feedback networks 660, 670 and 680 are sent to three respective signal phase invertors 662, 672 and 682 which produce negative feedback signals at 180 degrees out of phase with the feedback voltage signals from the voltage convertors of the feedback network. These negative feedback signals are accurate functions of both the moving speed and the displacement of diaphragms 630, 640 and 650 respectively. The negative feedback signals are fed in the proper proportion into a final summing network 690 where the negative feedback signals are combined with the input audio signal, and consequently the distortions of three respective electrodynamic loudspeakers 630, 640 and 650 are eliminated.

The present invention has many advantageous features including: (a) the negative feedback signal is an accurate function of the motion of the diaphragm of the loudspeaker which provides effective elimination of the distortion of the loudspeaker; (b) the components count of the loudspeaker is substantially reduced, so that the loudspeaker is much smaller and lighter; and (c) the components count of the feedback circuitry is substantially reduced, so that the overall circuitry is much more reliable and durable.

Defined in detail, the present invention is an electrodynamic loudspeaker comprising: (a) a housing, a pole piece, a primary magnet and a secondary iron core; (b) a diaphragm connected with a coil support; (c) a voice coil wound on the coil support and aligned with the primary magnet for driving the diaphragm according to an input signal; and (d) an electromagnetic impedance sensor coil wound on the coil support and partially offset with the secondary iron core for providing a feedback signal proportional to its electromagnetic impedance which is a function of both the moving speed and the displacement of the diaphragm.

In the embodiment defined in detail: (a) the voice coil is wound within an annular gap between the primary magnet and the coil support; (b) the electromagnetic impedance sensor coil is wound within an annular gap between the secondary iron core and the coil support; (c) the electromagnetic impedance sensor coil is wound on the coil between the voice coil and the diaphragm; (d) the electromagnetic impedance sensor coil is uniformly wound along an axial length of the coil support; and (e) the coil support is constructed by both non-conductive and conductive materials.

Defined alternatively in detail, the present invention is an electrodynamic loudspeaker comprising: (a) a housing, a pole piece and a magnet; (b) a diaphragm connected with a coil support; (c) an electromagnetic impedance sensor coil wound on the coil support; (d) a voice coil wound on the outer periphery of the sensor coil and aligned with the magnet for driving the diaphragm according to an input signal; and (e) the electromagnetic impedance sensor coil partially offset with the magnet for providing a feedback signal proportional to its electromagnetic impedance which is a function of both the moving speed and the displacement of the diaphragm.

In the embodiment defined alternatively in detail: (a) the voice coil and the electromagnetic impedance sensor coil are wound within an annular gap between the magnet and the coil support; (b) the electromagnetic impedance sensor coil is bifilarly wound along an axial length of the coil support; and (c) the coil support is constructed by both non-conductive and conductive materials.

Defined further alternatively in detail, the present invention is an electrodynamic loudspeaker comprising: (a) a housing, a hollow pole piece and a magnet, the pole piece having a longitudinal central rod; (b) a diaphragm connected with a longitudinal coil support, the coil support having a hollow end overlapped on said central rod of said pole piece; (c) a voice coil wound on said coil support and aligned with said magnet for driving said diaphragm according to an input signal; and (d) said central rod of said pole piece is constructed with two longitudinal conducting halves insulated by an insulating layer for providing a feedback signal proportional to the capacitance of the pole piece which is a function of both the moving speed and the displacement of said diaphragm.

In the embodiment defined further alternatively in detail: (a) the longitudinal coil support is constructed with two longitudinal conducting halves insulated by an insulating layer for providing a feedback signal proportional to the capacitance of the coil support which is a function of both the moving speed and the displacement of the diaphragm; and (b) the electrodynamic loudspeaker further comprises an electromagnetic impedance sensor coil wound on the coil support and partially offset with the magnet for providing a feedback signal proportional to its impedance which is a function of both the moving speed and the displacement of the diaphragm.

Defined broadly, the present invention is an electrodynamic loudspeaker comprising a primary magnet and a secondary iron core, means for driving a diaphragm according to an input signal with the presence of the primary magnet, and an electromagnetic impedance sensor coil partially offset with the secondary iron core for providing a feedback signal proportional to its electromagnetic impedance which is a function of both the moving speed and the displacement of the diaphragm.

Alternatively defined broadly, the present invention is an electrodynamic loudspeaker comprising a magnet, means for driving a diaphragm according to an input signal with the presence of the magnet, and an electromagnetic impedance sensor coil partially offset with the magnet for providing a feedback signal proportional to its electromagnetic impedance which is a function of both the moving speed and the displacement of the diaphragm.

Further alternatively defined broadly, the present invention is an electrodynamic loudspeaker comprising a hollow pole piece, a magnet, means for driving a diaphragm according to an input signal with the presence of the magnet, and means for providing a feedback signal proportional to the capacitance of the pole piece which is a function of both the moving speed and the displacement of the diaphragm.

Defined more broadly, the present invention is an electro-acoustic system comprising: (a) an amplifier means for amplifying an input signal to provide an amplified signal; (b) at least one electrodynamic loudspeaker comprising a hollow pole piece, a primary magnet and a secondary iron core, means for driving a diaphragm according to an input signal with the presence of the primary magnet, and an electromagnetic impedance sensor coil partially offset with the secondary iron core for providing a feedback signal proportional to its electromagnetic impedance which is a function of both the moving speed and the displacement of the diaphragm; (c) a negative feedback circuitry for processing the feedback signal and providing a negative feedback signal; and (d) a summing circuitry for combining the input signal and the negative feedback signal and sending a combined signal to the amplifier means, which in turn provides an amplified combined signal to the at least one electrodynamic loudspeaker to thereby reduce the distortion of the at least one electrodynamic loudspeaker Alternatively defined more broadly, the present invention is an electro-acoustic system comprising: (a) an amplifier means for amplifying an input signal to provide an amplified signal; (b) at least one electrodynamic loudspeaker comprising a hollow pole piece, a magnet, means for driving a diaphragm according to an input signal with the presence of the magnet, and an electromagnetic impedance sensor coil partially offset with the magnet for providing a feedback signal proportional to its electromagnetic impedance which is a function of both the moving speed and the displacement of the diaphragm; (c) a negative feedback circuitry for processing the feedback signal and providing a negative feedback signal; and (d) a summing circuitry for combining the input signal and the negative feedback signal and sending a combined signal to the amplifier means, which in turn provides an amplified combined signal to the at least one electrodynamic loudspeaker to thereby reduce the distortion of the at least one electrodynamic loudspeaker.

Further alternatively defined more broadly, the present invention is an electro-acoustic system comprising: (a) an amplifier means for amplifying an input signal to provide an amplified signal; (b) at least one electrodynamic loudspeaker comprising a hollow pole piece, a magnet, means for driving a diaphragm according to an input signal with the presence of the magnet, and means for providing a feedback signal proportional to the capacitance of the pole piece which is a function of both the moving speed and the displacement of the diaphragm; (c) a negative feedback circuitry for processing the feedback signal and providing a negative feedback signal; and (d) a summing circuitry for combining the input signal and the negative feedback signal and sending a combined signal to the amplifier means, which in turn provides an amplified combined signal to the at least one electrodynamic loudspeaker to thereby reduce the distortion of the at least one electrodynamic loudspeaker.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An electrodynamic loudspeaker apparatus, comprising:

a. an electrodynamic loudspeaker having a housing, a pole piece, a primary magnet, a secondary ion core and a diaphragm connected with a coil support;

b. said loudspeaker also comprising a voice coil, the voice coil being wound on said coil support and aligned with said primary magnet for driving said diaphragm according to an input signal;

c. said loudspeaker further comprising an electromagnetic impedance sensor coil, the impedance sensor coil being wound on said coil support and partially offset with said secondary iron core, causing said impedance sensor coil to have an electromagnetic impedance which is a function of both the displacement and the speed of said diaphragm; and d. means for measuring said electromagnetic impedance of said impedance sensor coil to provide a feedback signal;

e. whereby said feedback signal can be combined with said input signal to effectuate the elimination of the distortion of said electrodynamic loudspeaker.

2. The invention as defined in claim 1 wherein said voice coil is wound within an annular gap between said primary magnet and said coil support.

3. The invention as defined in claim 1 wherein said electromagnetic impedance sensor coil is wound within an annular gap between said secondary iron core and said coil support.

4. The invention as defined in claim 1 wherein said electromagnetic impedance sensor coil is wound on said coil support between said voice coil and said diaphragm.

5. The invention as defined in claim 1 wherein said electromagnetic impedance sensor coil is uniformly wound along an axial length of said coil support.

6. The invention as defined in claim 1 wherein said coil support is constructed by both non-conductive and conductive materials.

7. An electrodynamic loudspeaker apparatus, comprising:

a. an electrodynamic loudspeaker having a housing, a pole piece, a magnet and a diaphragm connected with a coil support;

b. said loudspeaker also comprising an electromagnetic impedance sensor coil wound on said coil support;

c. said loudspeaker further comprising a voice coil wound on the outer periphery of said sensor coil and aligned with said magnetic for driving said diaphragm according to an input signal;

d. said impedance sensor coil being partially offset with said magnet, causing said impedance sensor coil to have an electromagnetic impedance which is a function of both the displacement and the speed of said diaphragm; and e. means for measuring said electromagnetic impedance of said impedance sensor coil to provide a feedback signal;

f. whereby said feedback signal can be combined with said input signal to effectuate the elimination of the distortion of said electrodynamic loudspeaker.

8. The invention as defined in claim 7 wherein said voice coil and said electromagnetic impedance sensor coil are wound within an annular gap between said magnet and said coil support.

9. The invention as defined in claim 7 wherein said electromagnetic impedance sensor coil is bifilarly wound along an axial length of said coil support.

10. The invention as defined in claim 7 wherein said coil support is constructed by both non-conductive and conductive materials.

11. An electrodynamic loudspeaker apparatus, comprising:

a. an electrodynamic loudspeaker having a housing, a magnet, a hollow pole piece which has a longitudinal central rod, and a diaphragm connected with a longitudinal coil support which has a hollow end overlapped on said central rod of said pole piece;

b. said loudspeaker also comprising a voice coil wound on said coil support and aligned with said magnet for driving said diaphragm according to an input signal;

c. said central rod of said pole piece being constructed with two longitudinal conducting halves, each half being generally semicylindrical shaped and the two halves being insulated by a longitudinal insulating layer, causing said pole piece to have a capacitance which is a function of both the displacement and the speed of said diaphragm; and d. means for measuring said capacitance of said pole piece to provide a feedback signal;

e. whereby said feedback signal can be combined with said input signal to effectuate the elimination of the distortion of said electrodynamic loudspeaker.

12. The invention as defined in claim 11 wherein said longitudinal coil support is also constructed with two longitudinal conducting halves, each half being generally semi-hollow-cylindrical shaped and the two halves being insulated by two longitudinal insulating strips, causing said coil support to have a capacitance as well, which is again a function of both the displacement and the speed of said diaphragm and can be measured by said capacitance measuring means.

13. The invention as defined in claim 11 further comprising, a. an electromagnetic impedance sensor coil being wound on said coil support and partially offset with said magnet, causing the impedance sensor coil to have an electromagnetic impedance which is also a function of both the displacement and the speed of said diaphragm; and b. means for measuring said electromagnetic impedance of said impedance sensor coil to provide an additional feedback signal;

c. whereby said additional feedback signal can also be combined with said input signal to effectuate the elimination of the distortion of said electrodynamic loudspeaker.

14. An electrodynamic loudspeaker apparatus, comprising, a. an electrodynamic loudspeaker having a primary magnet and a secondary iron core, and means for driving a diaphragm according to an input signal with the presence of the magnet;

b. said an electrodynamic loudspeaker further comprising an electromagnetic impedance sensor coil partially offset with said secondary iron core, causing said impedance sensor coil to have an electromagnetic impedance which is a function of both the displacement and the speed of said diaphragm; and c. means for measuring said electromagnetic impedance of said impedance sensor coil to provide a feedback signal;

d. whereby said feedback signal can be combined with said input signal to effectuate the elimination of the distortion of said electrodynamic loudspeaker.

15. The invention as defined in claim 14 wherein said means for driving said diaphragm in response to an input signal includes a coil support attached to said diaphragm and a voice coil wound on the coil support.

16. The invention as defined in claim 15 wherein said electromagnetic impedance sensor coil is uniformly wound along an axial length of said coil support.

17. The invention as defined in claim 15 wherein said coil support is constructed by both non-conductive and conductive materials.

18. An electrodynamic loudspeaker apparatus, comprising, a. an electrodynamic loudspeaker having a magnet and means for driving a diaphragm according to an input signal with the presence of the magnet;

b. said an electrodynamic loudspeaker further comprising an electromagnetic impedance sensor coil partially offset with said magnet, causing said impedance sensor coil to have an electromagnetic impedance which is a function of both the displacement and the speed of said diaphragm; and c. means for measuring said electromagnetic impedance of said impedance sensor coil to provide a feedback signal;

d. whereby said feedback signal can be combined with said input signal to effectuate the elimination of the distortion of said electrodynamic loudspeaker.

19. The invention as defined in claim 18 wherein said means for driving said diaphragm in response to an input signal includes a coil support attached to said diaphragm and a voice coil wound on the coil support.

20. The invention as defined in claim 19 wherein said electromagnetic impedance sensor coil is bifilarly wound along an axial length of said coil support.

21. The invention as defined in claim 19 wherein said coil support is constructed by both non-conductive and conductive materials.

22. An electrodynamic loudspeaker apparatus, comprising:

a. an electrodynamic loudspeaker having a housing, a magnet, a hollow pole piece, and a diaphragm connected with a coil support;

b. said loudspeaker also comprising means for driving said diaphragm according to an input signal with the presence of the magnet;

c. said coil support being constructed by both non-conductive and conductive materials and moving within the hollow of said pole piece, causing said pole piece to have a capacitance which is a function of both the displacement and the speed of said diaphragm; and d. means for measuring said capacitance of said pole piece to provide a feedback signal;

e. whereby said feedback signal can be combined with said input signal to effectuate the elimination of the distortion of said electrodynamic loudspeaker.

23. The invention as defined in claim 22 wherein said hollow pole piece has a central rod and said coil support has a hollow end overlapped on the central rod of said pole piece.

24. The invention as defined in claim 23 wherein said central rod of said pole piece is constructed with two longitudinal conducting halves, each half being generally semi-cylindrical shaped and the two halves being insulated by a longitudinal insulating layer.

25. The invention as defined in claim 23 wherein said coil support is constructed with two longitudinal conducting halves, each half being generally semi-hollow-cylindrical shaped and the two halves being insulated by two longitudinal insulating strips.

26. The invention as defined in claim 22 further comprising, a. an electromagnetic impedance sensor coil being wound on said coil support and partially offset with said magnet, causing the impedance sensor coil to have an electromagnetic impedance which is also a function of both the displacement and the speed of said diaphragm; and b. means for measuring said electromagnetic impedance of said impedance sensor coil to provide an additional feedback signal;

c. whereby said additional feedback signal can also be combined with said input signal to effectuate the elimination of the distortion of said electrodynamic loudspeaker.

27. An electro-acoustic system, comprising:

a. an amplifier means for amplifying an input signal to provide an amplified signal;

b. at least one electrodynamic loudspeaker comprising a hollow pole piece, a primary magnet and a secondary iron core, and means for driving a diaphragm according to said amplified signal with the presence of the magnet;

c. said at least one electrodynamic loudspeaker further comprising an electromagnetic impedance sensor coil partially offset with said secondary iron core, causing said impedance sensor coil to have an electromagnetic impedance which is a function of both the displacement and the speed of said diaphragm;

d. means for measuring said electromagnetic impedance of said impedance sensor coil to provide a feedback signal;

e. a negative feedback circuitry for processing said feedback signal and providing a negative feedback signal; and f. a summing circuitry for combining said input signal and said negative feedback signal and sending a combined signal to said amplifier means, which in turn provides an amplified combined signal to said at least one electrodynamic loudspeaker;

g. whereby said amplified combined signal can effectuate the elimination of the distortion of said at least one electrodynamic loudspeaker.

28. The invention as defined in claim 27 wherein said means for driving said diaphragm of said at least one electrodynamic loudspeaker in response to said amplified signal includes a coil support attached to said diaphragm and a voice coil wound on the coil support.

29. The invention as defined in claim 28 wherein said electromagnetic impedance sensor coil of said at least one electrodynamic loudspeaker is uniformly wound along an axial length of said coil support.

30. The invention as defined in claim 28 wherein said coil support of said at least one electrodynamic loudspeaker is constructed by both non-conductive and conductive materials.

31. The invention as defined in claim 28 further comprising means for measuring a capacitance of said hollow pole piece of said at least one electrodynamic loudspeaker caused by the movement of said coil support of said at least one electrodynamic loudspeaker within said hollow pole piece, which capacitance is also a function of both the displacement and the speed of said diaphragm of said at least one electrodynamic loudspeaker.

32. An electro-acoustic system comprising:

a. an amplifier means for amplifying an input signal to provide an amplified signal;

b. at least one electrodynamic loudspeaker comprising a hollow pole piece, a magnet and means for driving a diaphragm according to said amplified signal with the presence of the magnet;

c. said at least one electrodynamic loudspeaker further comprising an electromagnetic impedance sensor coil partially offset with said magnet, causing said impedance sensor coil to have an electromagnetic impedance which is a function of both the displacement and the speed of said diaphragm;

d. means for measuring said electromagnetic impedance of said impedance sensor coil to provide a feedback signal;

e. a negative feedback circuitry for processing said feedback signal and providing a negative feedback signal; and f. a summing circuitry for combining said input signal and said negative feedback signal and sending a combined signal to said amplifier means, which in turn provides an amplified combined signal to said at least one electrodynamic loudspeaker;

g. whereby said amplified combined signal can effectuate the elimination of the distortion of said at least one electrodynamic loudspeaker.

33. The invention as defined in claim 32 wherein said means for driving said diaphragm of said at least one electrodynamic loudspeaker in response to said amplified signal includes a coil support attached to said diaphragm and a voice coil wound on the coil support.

34. The invention as defined in claim 33 wherein said electromagnetic impedance sensor coil of said at least one electrodynamic loudspeaker is bifilarly wound along an axial length of said coil support.

35. The invention as defined in claim 33 wherein said coil support of said at least one electrodynamic loudspeaker is constructed by both non-conductive and conductive materials.

36. The invention as defined in claim 33 further comprising means for measuring a capacitance of said hollow pole piece of said at least one electrodynamic loudspeaker caused by the movement of said coil support of said at least one electrodynamic loudspeaker within said hollow pole piece, which capacitance is also a function of both the displacement and the speed of said diaphragm of said at least one electrodynamic loudspeaker.

37. An electro-acoustic system comprising:

a. an amplifier means for amplifying an input signal to provide an amplified signal;

b. at least one electrodynamic loudspeaker comprising a hollow pole piece, a magnet, a diaphragm connected with a coil support, and means for driving the diaphragm according to said amplified signal with the presence of the magnet;

c. said coil support being constructed by both non-conductive and conductive material and moving within the hollow of said pole piece, causing said pole piece to have a capacitance which is a function of both the displacement and the speed of said diaphragm;

d. means for measuring said capacitance of said pole piece to provide a feedback signal;

e. a negative feedback circuitry for processing said feedback signal and providing a negative feedback signal; and f. a summing circuitry for combining said input signal and said negative feedback signal and sending a combined signal to said amplifier means, which in turn provides an amplified combined signal to said at least one electrodynamic loudspeaker;

g. whereby said amplified combined signal can effectuate the elimination of the distortion of said electrodynamic loudspeaker.

38. The invention as defined in claim 37 wherein said hollow pole piece of said at least one electrodynamic electrodynamic loudspeaker has a central rod and said coil support of said at least one electrodynamic loudspeaker has a hollow end overlapped on the central rod of said pole piece.

39. The invention as defined in claim 38 wherein said central rod of said pole piece is constructed with two longitudinal conducting halves, each half being generally semi-cylindrical shaped and the two halves being insulated by a longitudinal insulating layer.

40. The invention as defined in claim 38 wherein said coil support is constructed with two longitudinal conducting halves, each half being generally semi-hollow-cylindrical shaped and the two halves being insulated by two longitudinal insulating strips.

41. The invention as defined in claim 37 further comprising, a. an electromagnetic impedance sensor coil being wound on said coil support of said at least one electrodynamic loudspeaker and partially offset with said magnet of said at least one electrodynamic loudspeaker, causing the impedance sensor coil to have an electromagnetic impedance which is also a function of both the displacement and the speed of said diaphragm of said at least one electrodynamic loudspeaker; and b. means for measuring said electromagnetic impedance of said impedance sensor coil to provide an additional feedback signal to said summing circuitry.

* * * * *